US007654400B2

(12) United States Patent
Orr

(10) Patent No.: US 7,654,400 B2
(45) Date of Patent: Feb. 2, 2010

(54) TOOL HOLDER

(76) Inventor: Joseph C. Orr, 1500 W. 4300, South Rexburg, ID (US) 83440

( * ) Notice: Subject to any disclaimer, the term of this patent is extended or adjusted under 35 U.S.C. 154(b) by 127 days.

(21) Appl. No.: 11/844,282

(22) Filed: Aug. 23, 2007

(65) Prior Publication Data

US 2009/0026156 A1 Jan. 29, 2009

Related U.S. Application Data

(60) Provisional application No. 60/952,102, filed on Jul. 26, 2007.

(51) Int. Cl.
*A47F 7/00* (2006.01)

(52) U.S. Cl. ..... 211/70.6

(58) Field of Classification Search ..... 211/70.6, 211/65, 66, 60.1, 106, 119; 248/309.1, 302; D6/566; D8/71, 354–356, 367, 370, 373, D8/380

See application file for complete search history.

(56) References Cited

U.S. PATENT DOCUMENTS

| | | | | | |
|---|---|---|---|---|---|
| 2,410,972 | A | * | 11/1946 | Hickman | 211/65 |
| 2,996,192 | A | * | 8/1961 | Dell et al. | 211/49.1 |
| 3,095,092 | A | | 6/1963 | Megarian | |
| 3,187,902 | A | | 6/1965 | Nelson | |
| 3,374,898 | A | * | 3/1968 | Karmin | 248/220.41 |
| 3,721,348 | A | * | 3/1973 | Cook | 211/70.6 |
| 4,064,991 | A | * | 12/1977 | Swanson | 211/49.1 |
| 4,723,663 | A | * | 2/1988 | Learn | 211/59.2 |
| 4,742,923 | A | * | 5/1988 | Calvert | 211/57.1 |
| 4,895,334 | A | | 1/1990 | Bajek et al. | |
| 4,905,846 | A | * | 3/1990 | Calvert | 211/59.1 |
| 5,095,649 | A | * | 3/1992 | Brownlee | 47/41.01 |
| 5,143,228 | A | * | 9/1992 | Arnold | 211/70.6 |
| 5,388,709 | A | * | 2/1995 | Adams | 211/70.6 |
| 5,411,191 | A | | 5/1995 | Bunn, Jr. | |
| 5,476,240 | A | * | 12/1995 | McDonough | 248/213.2 |
| 5,531,415 | A | * | 7/1996 | Kallemeyn | 248/220.31 |
| 6,129,222 | A | * | 10/2000 | Mylander et al. | 211/106 |
| 6,254,053 | B1 | * | 7/2001 | Taser | 248/313 |
| 6,681,940 | B1 | | 1/2004 | Cash et al. | |
| 6,969,036 | B2 | | 11/2005 | Magnusson | |
| 7,036,668 | B2 | | 5/2006 | Udy | |
| 2006/0037920 | A1 | | 2/2006 | Baranya | |

FOREIGN PATENT DOCUMENTS

| | | |
|---|---|---|
| FR | 2548529 | 11/1985 |

* cited by examiner

*Primary Examiner*—Sarah Purol
(74) *Attorney, Agent, or Firm*—Christopher Wood; Wood & Eisenberg, PLLC

(57) ABSTRACT

A tool holder. The tool holder includes a back plate and a tubular tool support assembly. The tubular tool support assembly has opposite first and second ends. The first end is attached to the back plate such that when the back plate is held in a vertical plane the tubular tool support assembly extends at a downward angle away from the front face surface of the back plate. The tubular tool support assembly defines upper and lower downward sloping sides of which the upper side comprises a plurality of handle bar sections each comprising upper and lower tube sections and a middle tube section therebetween. At least one lower tube section is aligned in a horizontal plane when the back plate is aligned in a vertical plane, and at least one lower tube section forms part of a tool support hook.

4 Claims, 12 Drawing Sheets

160
200
180
120
300
340
360
140
300
240
340
360
220
260
320
100

TOOL HOLDER

CROSS-REFERENCE TO RELATED APPLICATIONS

This application claims the benefit of priority from U.S. Provisional Patent Application Ser. No. 60/952,102 (filed Jul. 26, 2007).

STATEMENT REGARDING FEDERALLY SPONSORED RESEARCH OR DEVELOPMENT

Not Applicable.

FIELD OF THE INVENTION

This invention relates generally to mounts or holders for tools and more particularly to a tool holder for holding tools and implement such as, but not limited to, garden tools. More specifically, the invention is a tool holder adapted to attach to a vertical support such as a garage wall or garden shed wall.

BACKGROUND OF THE INVENTION

As noted in U.S. Pat. No. 3,985,324, issued Oct. 12, 1976 to Larson, garden tools such as rakes, shovels, hand hoes and the like are often stored in locations where the tools may become a hazard to persons in their vicinity. Unwary or careless people may step on a sharp or pointed tool end, or brush against a precariously balanced implement. These encounters invariably cause aggravation, and can cause serious injury leading to otherwise avoidable medical bills and risk to life, limb and property.

To eliminate such hazards, many people hang such tools on hooks, pegs, nails, or other wall mounts. However, the amount of wall surface available for hanging such tools is often limited, and it is common practice to store a number of tools in stacked relationship upon the same hook or peg. Stacked and hung tools are also hazardous since the endmost tool may fall from the stack, and since the supportive mount may be unable to carry the aggregate weight of these tools. Thus, there is a need for new and/or improved tool holders.

SUMMARY OF THE INVENTION

A tool holder. The tool holder includes a back plate and a tubular tool support assembly. The tubular tool support assembly has opposite first and second ends. The first end is attached to the back plate such that when the back plate is held in a vertical plane the tubular tool support assembly extends at a downward angle away from the front face surface of the back plate. The tubular tool support assembly defines upper and lower downward sloping sides of which the upper side comprises a plurality of handle bar sections each comprising upper and lower tube sections and a middle tube section therebetween. At least one lower tube section is aligned in a horizontal plane when the back plate is aligned in a vertical plane, and at least one lower tube section forms part of a tool support hook.

BRIEF DESCRIPTION OF THE DRAWINGS

Similar reference characters denote corresponding features consistently throughout the attached drawings.

DETAILED DESCRIPTION OF THE INVENTION

This invention is directed to a tool holder adapted to attach to a vertical support such as a garage wall or garden shed wall. The tool holder of the present invention is denoted generally by the numeric label "100".

Figure 1:
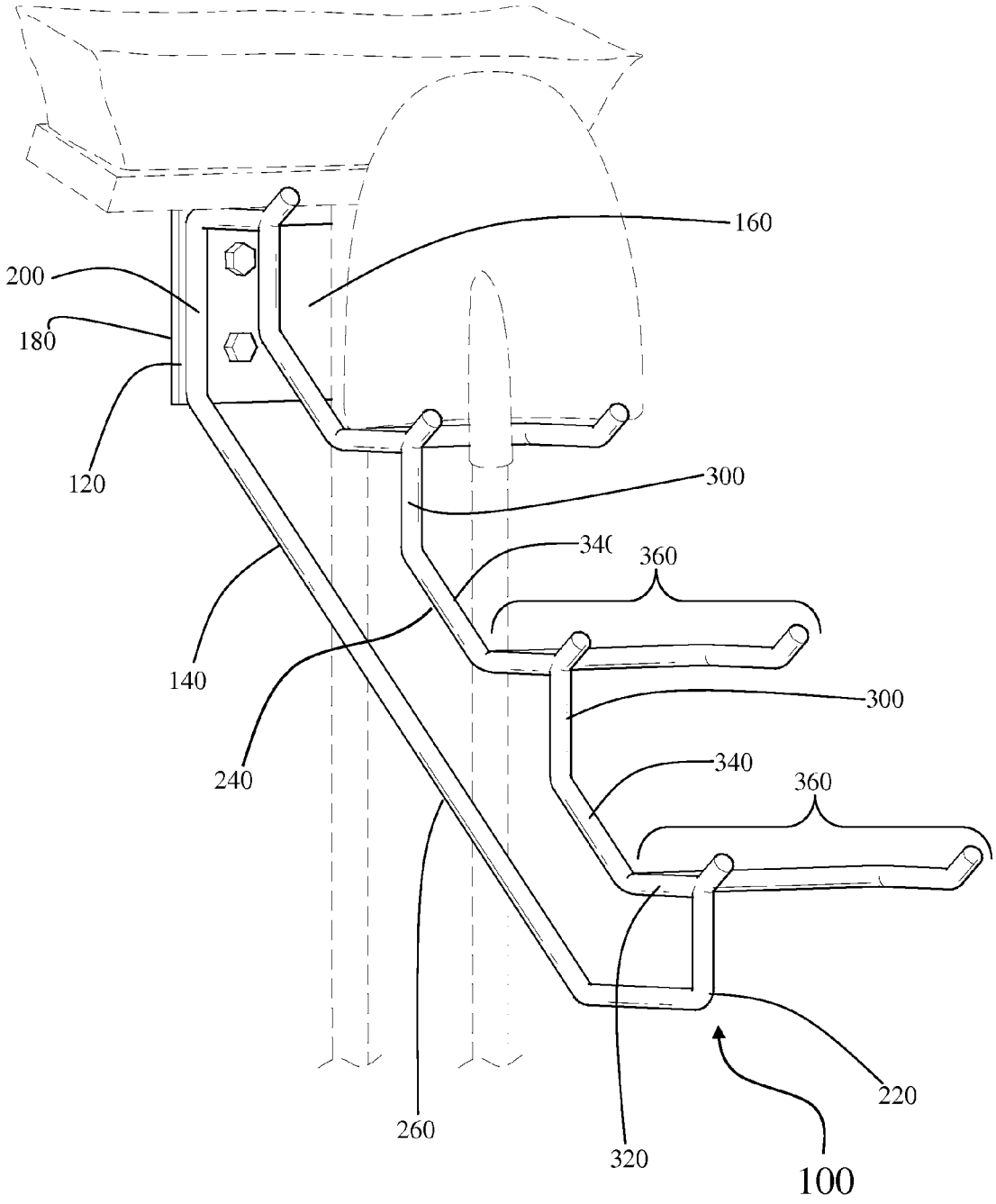
FIG. 1 is an environmental perspective view of a tool holder according to the present invention.

Referring to the Figures in general, the tool holder 100 of the present invention comprises a back plate 120 and a tubular tool support assembly 140. The back plate 120 defines a front face surface 160 and a rear side 180. During normal use the rear side 180 of the back plate 120 is affixed in the vertical plane against a vertical support VS such as a garage or shed wall. Tools and implements such as shovels and brushes are temporarily stored on the tool holder 100 as shown in dashed lines in FIG. 1. The tubular tool support assembly 140 defines a left side 700 and a right side 800.

The tool support assembly 140 can be made out of any suitable material such as aluminum tubing, steel tubing, copper tubing, metal alloy tubing, and plastic tubing, alone or in combination. The back plate 120 can be made out of any suitable material such as steel, aluminum, copper, hard wood, and brass, alone or in combination. The back plate 120 can be attached to a suitable vertical support using, for example, bolts 125 or screws (not shown) through apertures 130 located through the back plate 120.

Figure 11:
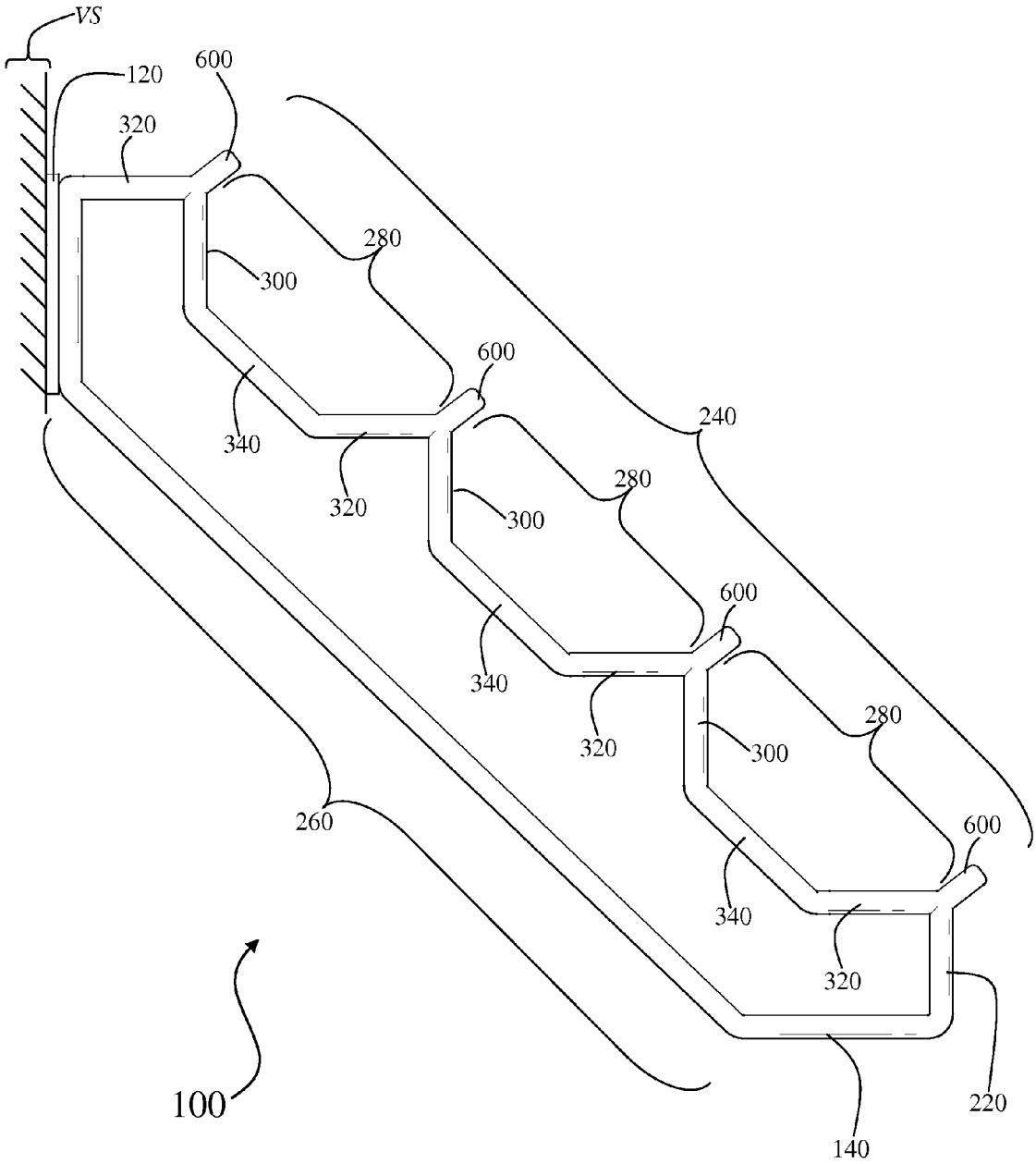
FIG. 11 shows a left-side view of the tool holder shown in FIG. 1, wherein the tool holder is attached to a vertical support.
Figure 12:
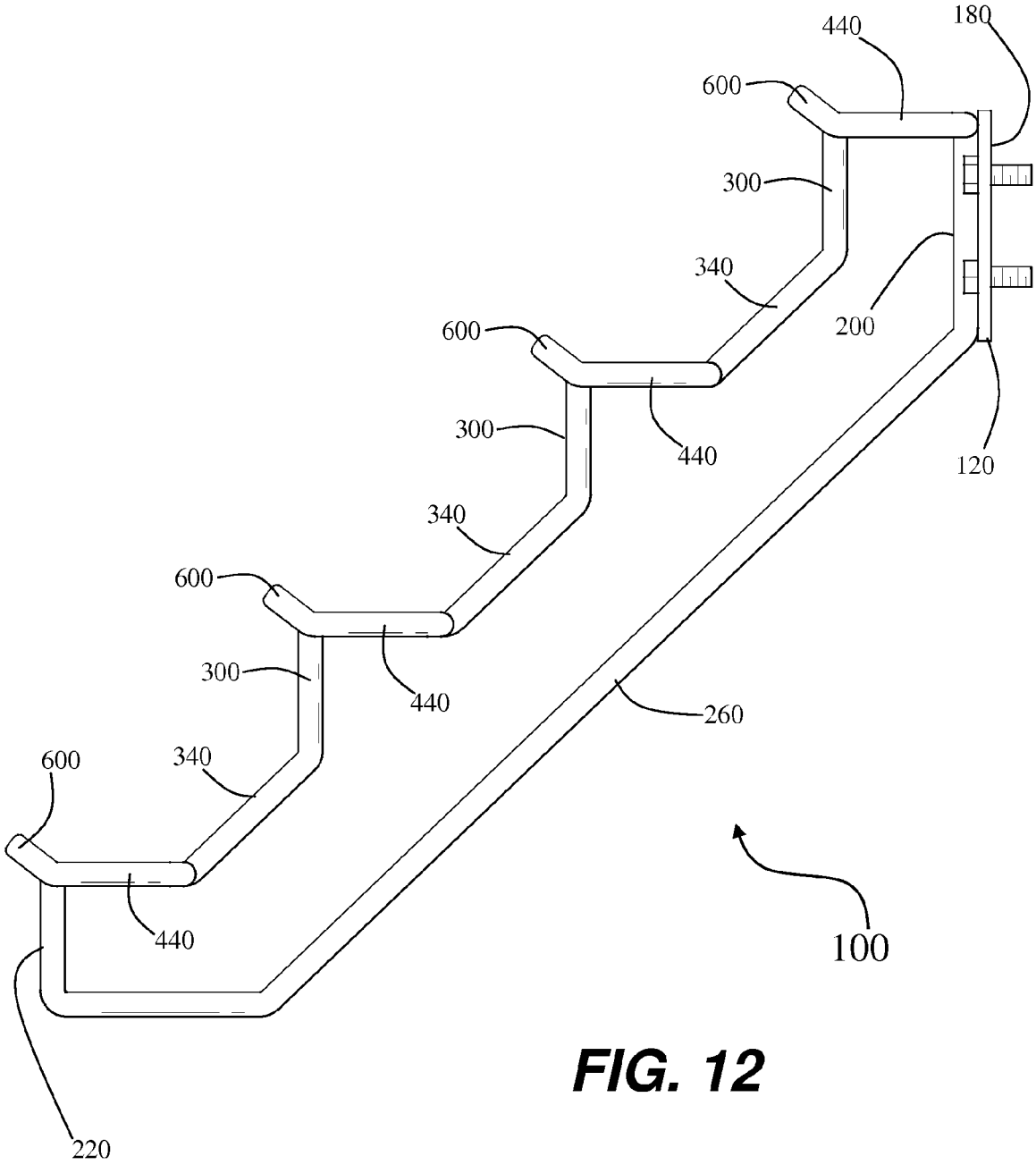
FIG. 12 shows a right-side view of the tool holder shown in FIG. 1.

Referring to the tool holder 100 during actual use with its rear side 180 attached to a vertical surface VS, e.g., see FIG. 11. The tubular support assembly 140 has opposite first and second ends 200 and 220, respectively. The first end 200 of the support assembly 140 is attached to the face 160 side of back plate 120 such that when the back plate 120 is held in the vertical plane or when affixed to a vertical support the support assembly 140 extends at a downward angle away from the face 160 of the back plate 140. The support assembly 140 defines upper and lower sides 240 and 260, respectively. The upper and lower sides 240 and 260 both slope at a downward angle away from the front face 160 of back plate 120. The upper side 240 comprising a plurality of handlebar sections 280 (i.e., at least two handlebar sections 280) which during ordinary use of the tool holder 100 are aligned in a vertical plane and in an angled down direction with respect to the front face surface 160 of back plate 120.

Figure 4:
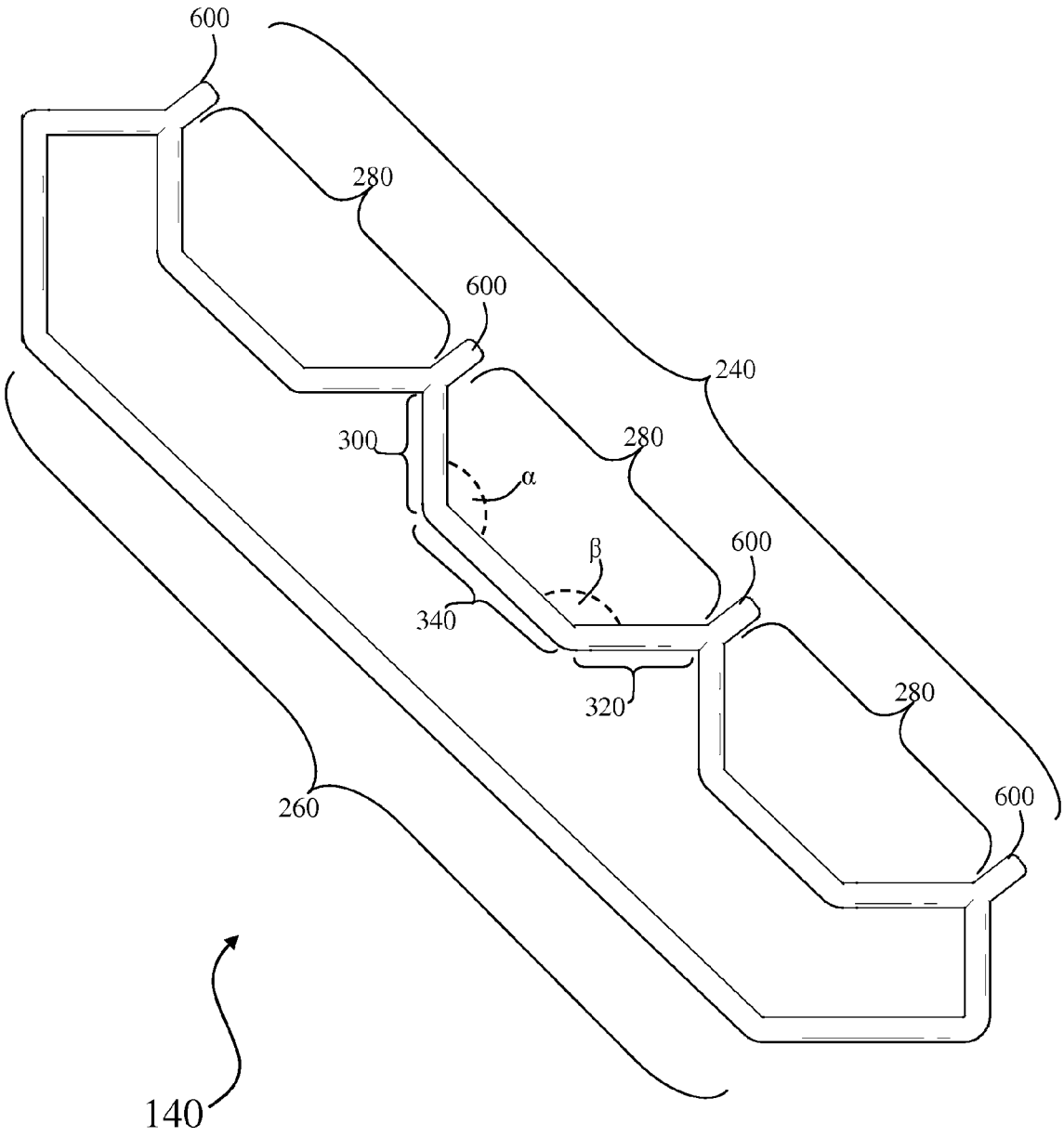
FIG. 4 is a side view of a tool holder according to the present invention.

Each of the handlebar sections 280 define an upper tube section 300 and a lower tube section 320 with a middle tube section 340 therebetween. The handlebar sections 280 resemble a regular trapezoid with the middle tube section 340 representing the shorter parallel side of a regular trapezoid except that the longer parallel of what would otherwise be a regular trapezoid side is missing from each handlebar section 280. More specifically, tube sections 300 and 320 are of equal length and with respect to the middle tube section 340 respectively define internal angles $\alpha$ and $\beta$; the internal angles $\alpha$ and $\beta$ are equal or substantially equal in magnitude (see FIG. 4). Upper side 240 of tubular tool support assembly 140 is configured such that each tube section 320 is aligned in the horizontal plane when the back plate 120 is aligned in the vertical plane, e.g. as when the vertical plate 120 is affixed to a vertical support such as, but not limited to, a wall of a garage or garden shed.

During normal use (i.e., when the back plate 120 is affixed to a vertical support such as a garage or shed wall) each lower tube section 320 is aligned in the horizontal plane or substantially in the horizontal plane. At least one of the lower tube sections 320 forms part of a tool support hook 360.

Figure 2:
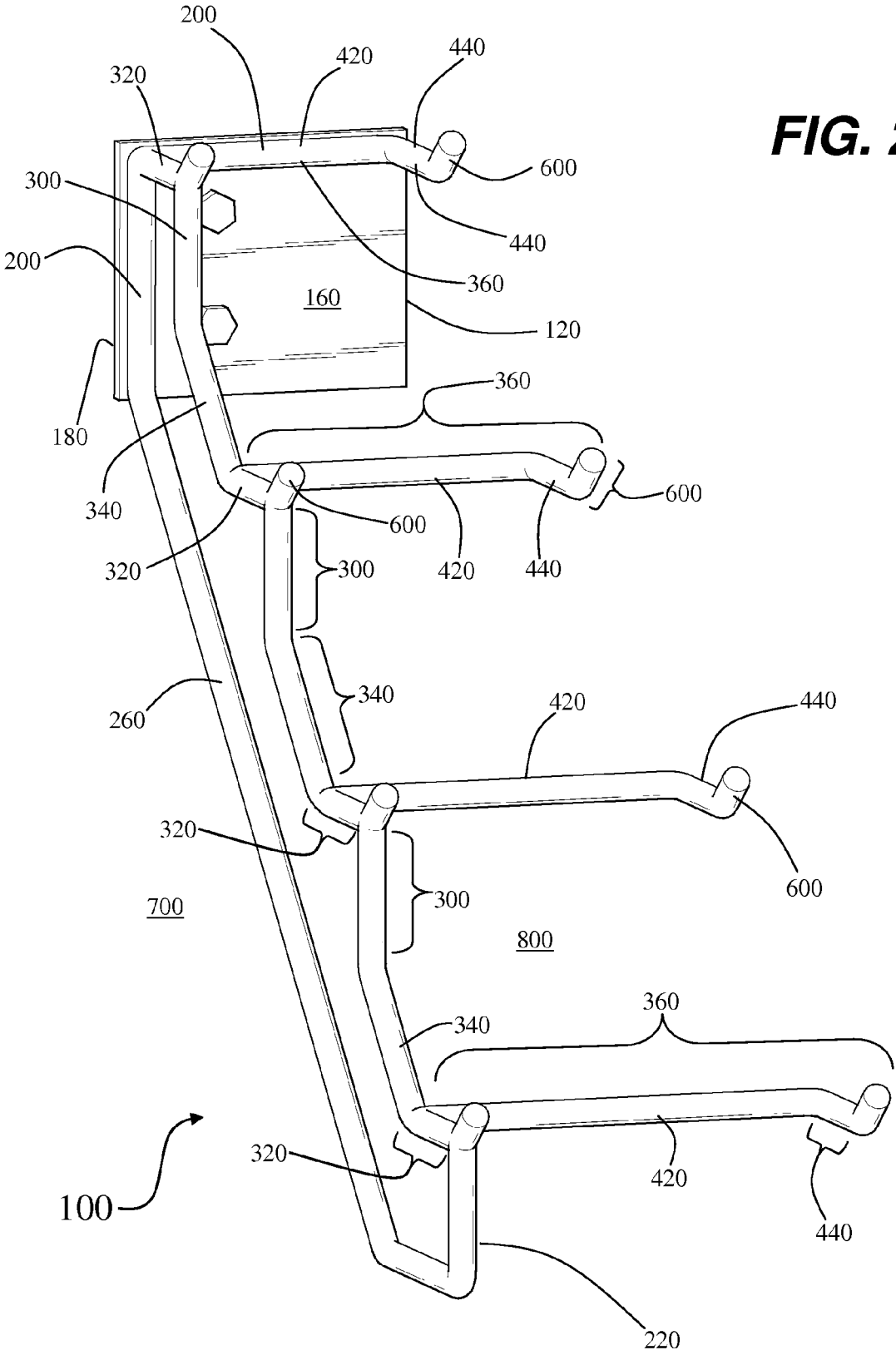
FIG. 2 is a perspective view of the tool holder shown in FIG. 1.
Figure 3:
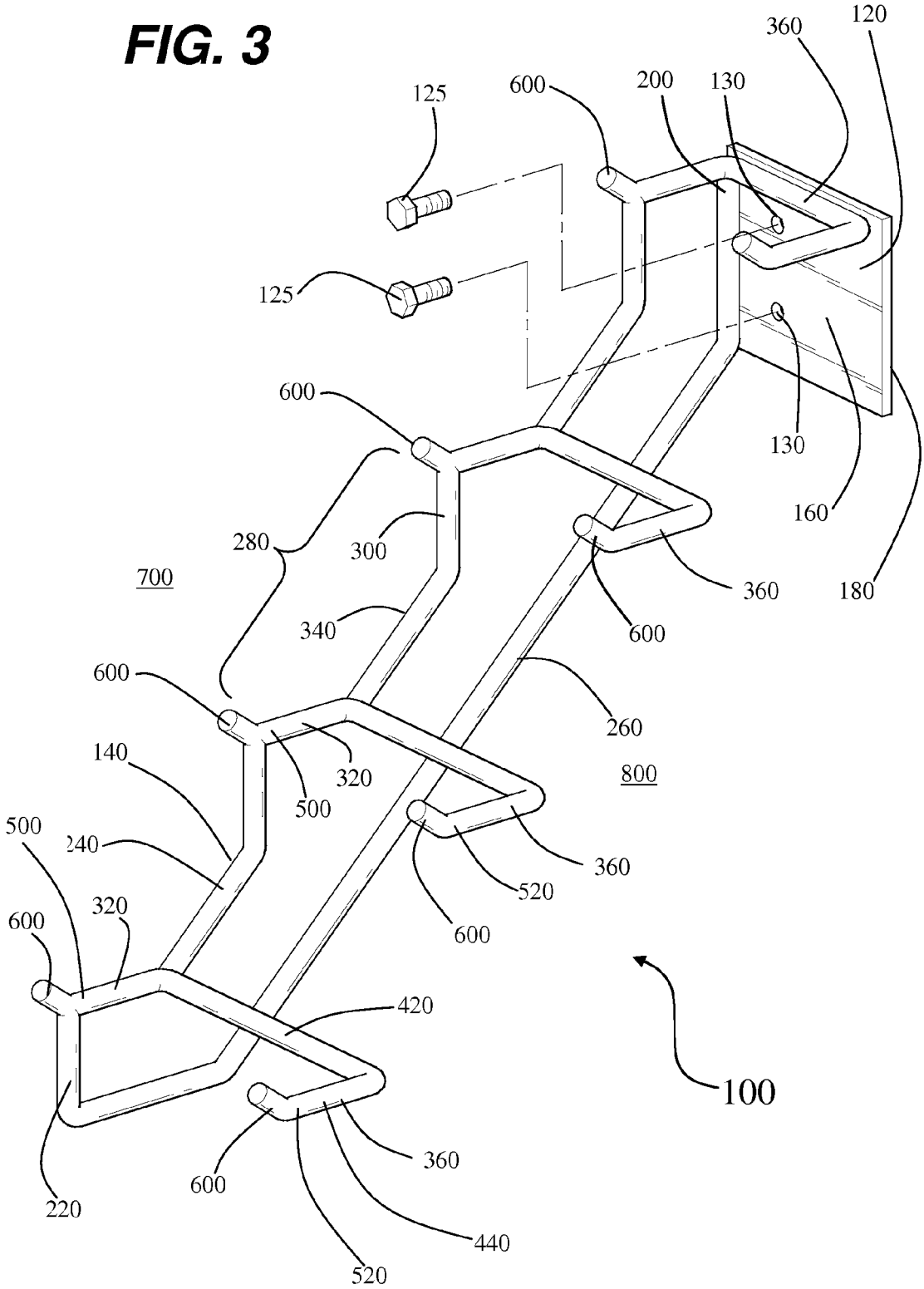
FIG. 3 is a perspective side view of the tool holder shown in FIG. 1.

Each tool support hook 360 has a generally square or rectangular open U-shape comprising a lower tube section 320, a middle tool holder section 420, and an outer tube section 440. The tube sections 320 and 440 are parallel. Each tool support hook 360 is aligned in a horizontal plane when the tool holder 100 is attached to a vertical support such as a wall; specifically, each tool support hook 360 is aligned in a horizontal plane when the back-plate 120 is affixed to a vertical support VS. Each tool support hook 360 defines opposite ends 500 and 520, e.g., see FIG. 3. A tool support hook 360 can be attached to ends 200 and/or 220. The tool support hooks 360 extend sideways from the upper side 240 of the tool support assembly 140. The tubular support assembly 140 has right and left sides. The plurality of tool support hooks 360 can straddle one or both sides (i.e., left side 700 or right side 800, or both left and right sides 700 and 800 of the tool support assembly 140) of the tubular tool support assembly 140 (e.g., see FIG. 2 verses FIG. 5). The width of the tool support hooks 360 can vary; e.g., in FIG. 2 the width of the tool support hooks 360 increases in a downward direction, e.g., the tool support hook proximate to opposite first end 200 is less wide than the tool support hook proximate to opposite second end 220.

A tool hook 360 forms an integral part of end 200 may or may not be affixed to front face surface 160 of back plate 120; more specifically, the middle tube section 420 is optionally affixed to front face surface 160 of back plate 120, for example, by spot welding or mechanically by suitable screws and/or bolts.

An optional tool-stopper 600 can be fitted to each opposite end 500 and 520. The tool-stoppers 600 help prevent a tool such as a shovel, fork or brush placed on a tool support hook 360 from accidentally being knocked off the tool holder 100. It will be understood that the optional tool-stoppers 600 can take several forms such as a vertical stud or vertical protrusion of sufficient dimensions to stop a tool from sliding or otherwise accidentally being pushed off a tool support hook 360.

During ordinary use of the tool holder 100 (i.e., such as when the back-plate 120 is affixed to a vertical support VS, e.g., see FIG. 11) each tool support hook 360 is aligned in a horizontal plane and extends sideways in a horizontal plane from the upper side 240 of tool support assembly 140. The middle tube sections 340 and lower side 260 of the support assembly 140 are aligned in the same vertical plane. The lower side 260 is substantially parallel to the middle tube sections 340.

In one aspect of the invention, the tool holder 100 comprises back plate 120 and tubular tool support assembly 140. The back plate 120 defines a front face surface 160 and a rear side 180. The tubular tool support assembly 140 defines opposite first and second ends 200 and 220, respectively. The first end 200 of the tubular tool support assembly 140 is attached to the front face surface 160 of the back plate 120 such that when the back plate 120 is held in a vertical plane then the tubular tool support assembly 140 extends at a downward angle from the front face surface 160 of the back plate 120. The tubular tool support assembly 140 defines upper and lower downward sloping sides 240 and 260, respectively. The upper side 240 comprises a plurality of handle bar sections 280. Each of the handle bar sections 280 define an upper tube section 300, a lower tube section 320 and a middle tube section 340 between the upper and lower tube sections 300 and 320, respectively. At least one of the lower tube sections 320 is aligned in a horizontal plane when the back plate 120 is aligned in a vertical plane. At least one of the lower tube sections 320 forms part of a tool support hook 360. At least one support hook is aligned in a horizontal plane when the back plate 120 is aligned in a vertical plane. The tool support hooks 360 extend sideways from the upper side 240 of the tool support assembly 140. Each tool support hook 360 has a generally square or rectangular open U-shape comprising a lower tube section 320, a middle tool holder section 420, and an outer tube section 440. The lower side 260 of the tubular tool support assembly 140 is substantially parallel to at least one middle tube section 340. The tool support hooks 360 can extend outwards from either the left 700 or right side 800 of the tool support assembly 140.

Figure 5:
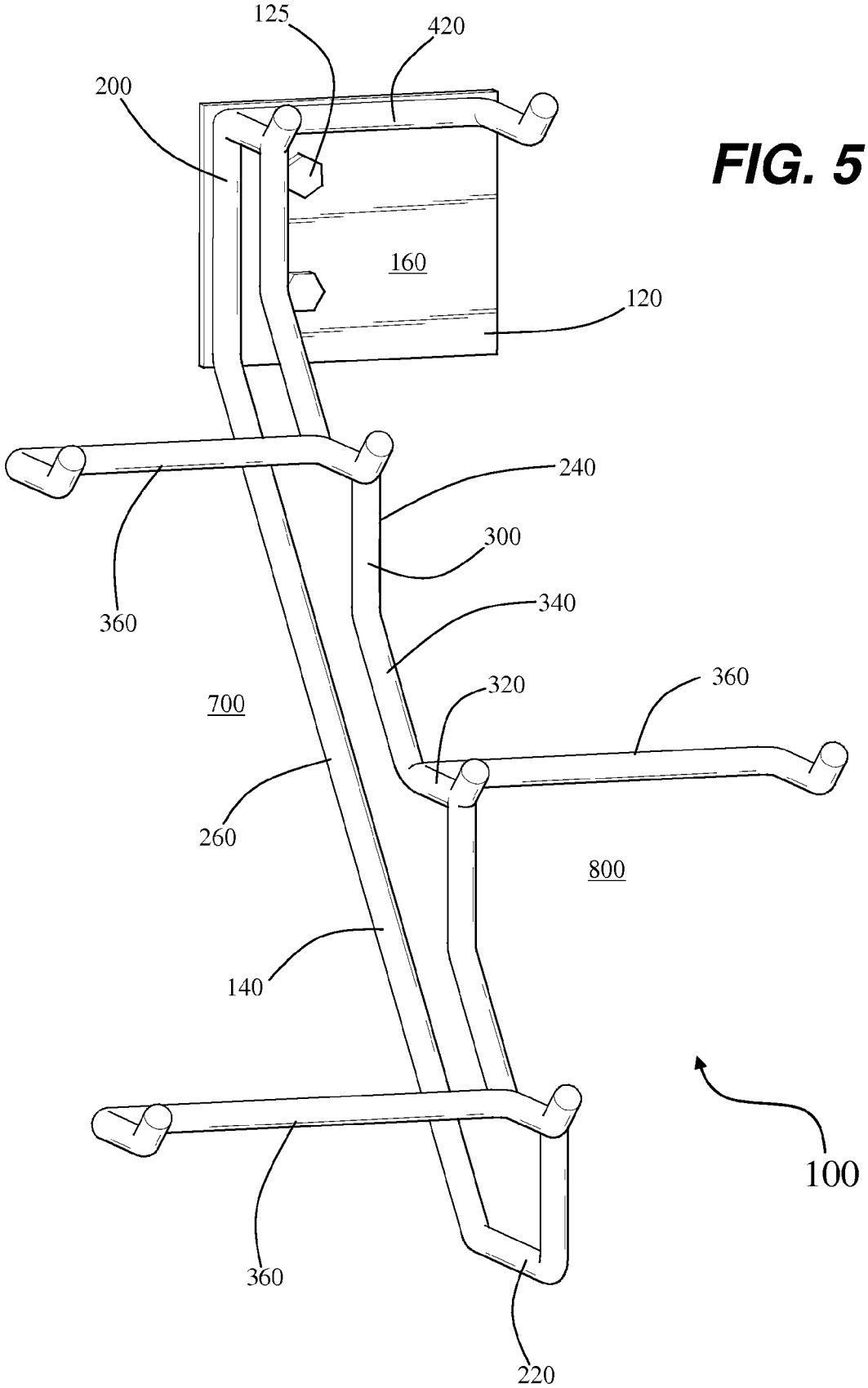
FIG. 5 shows a perspective view of a tool holder according to the present invention.
Figure 6:
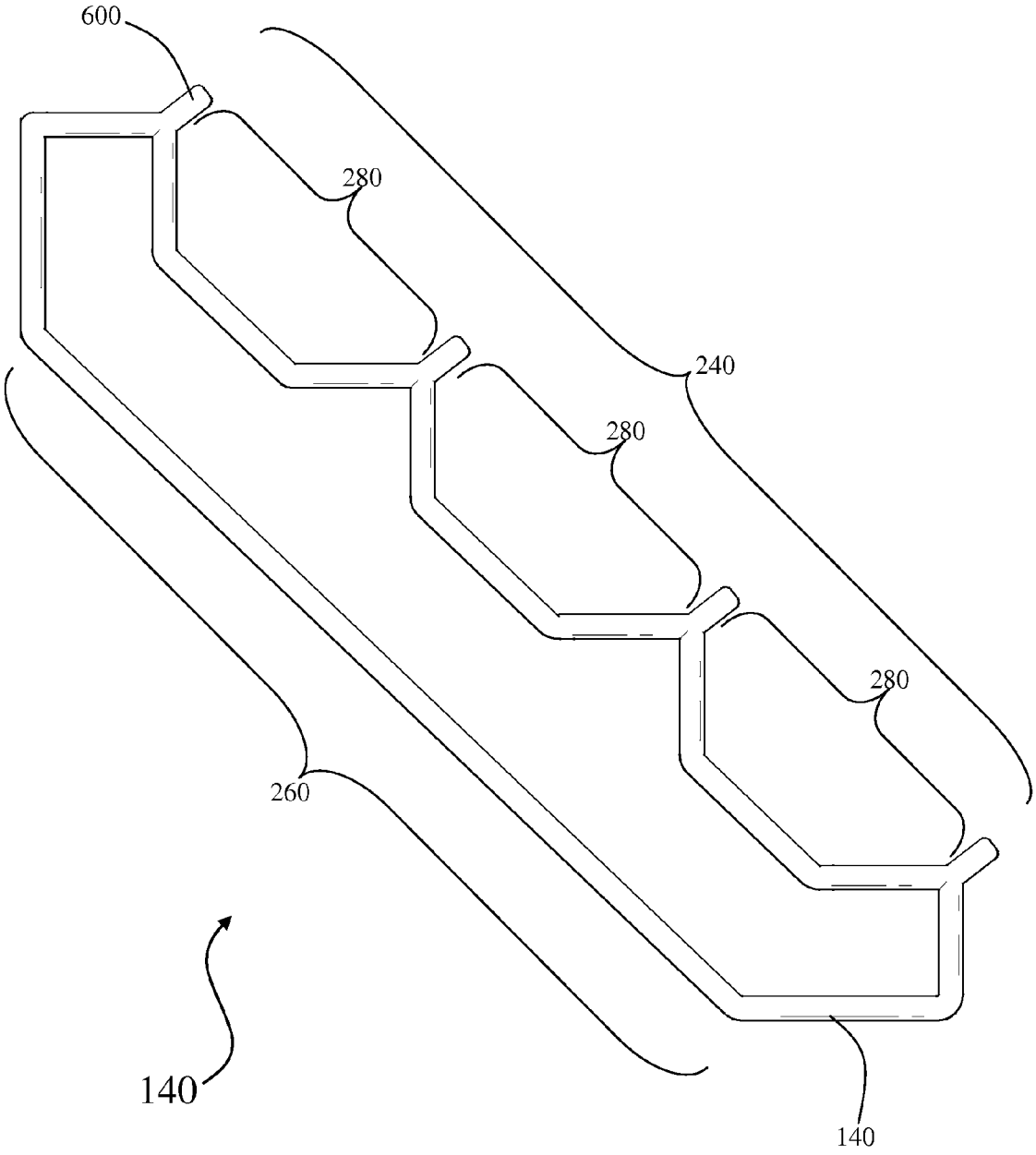
FIG. 6 shows a left-side view of a tubular tool support assembly according to the present invention.
Figure 7:
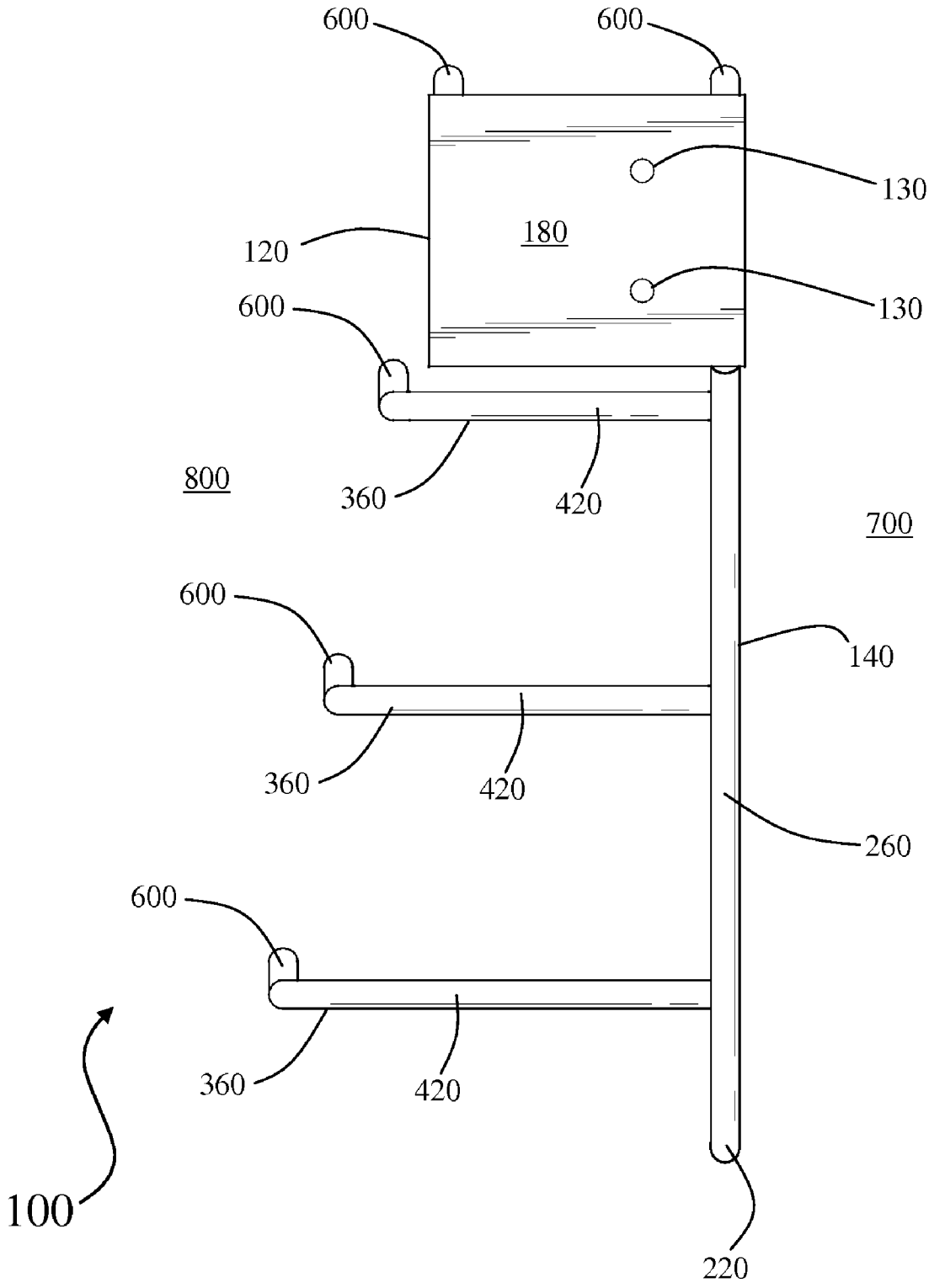
FIG. 7 shows a rear view of the tool holder shown in FIG. 1.
Figure 8:
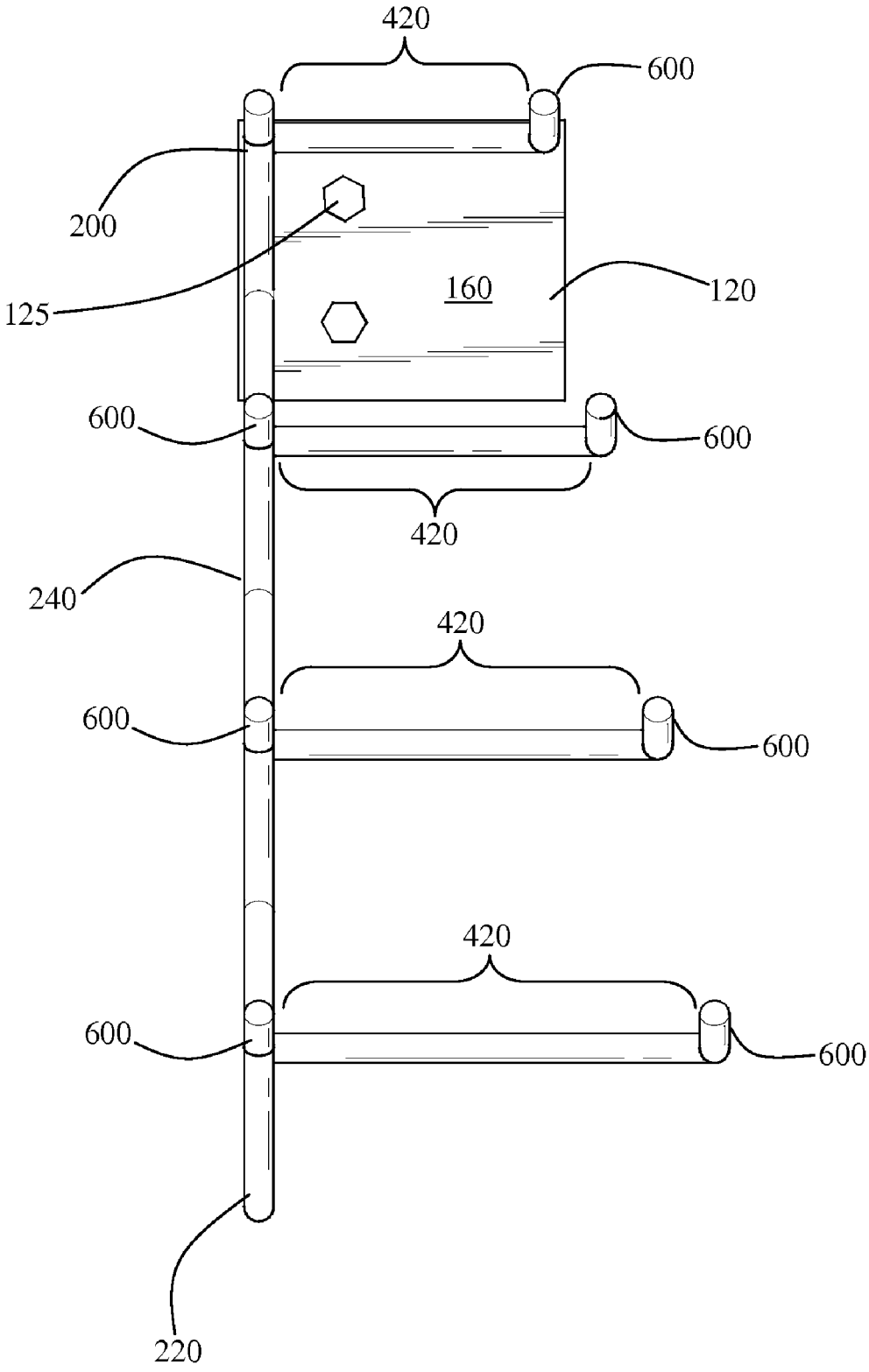
FIG. 8 shows a front view of the tool holder shown in FIG. 1.
Figure 9:
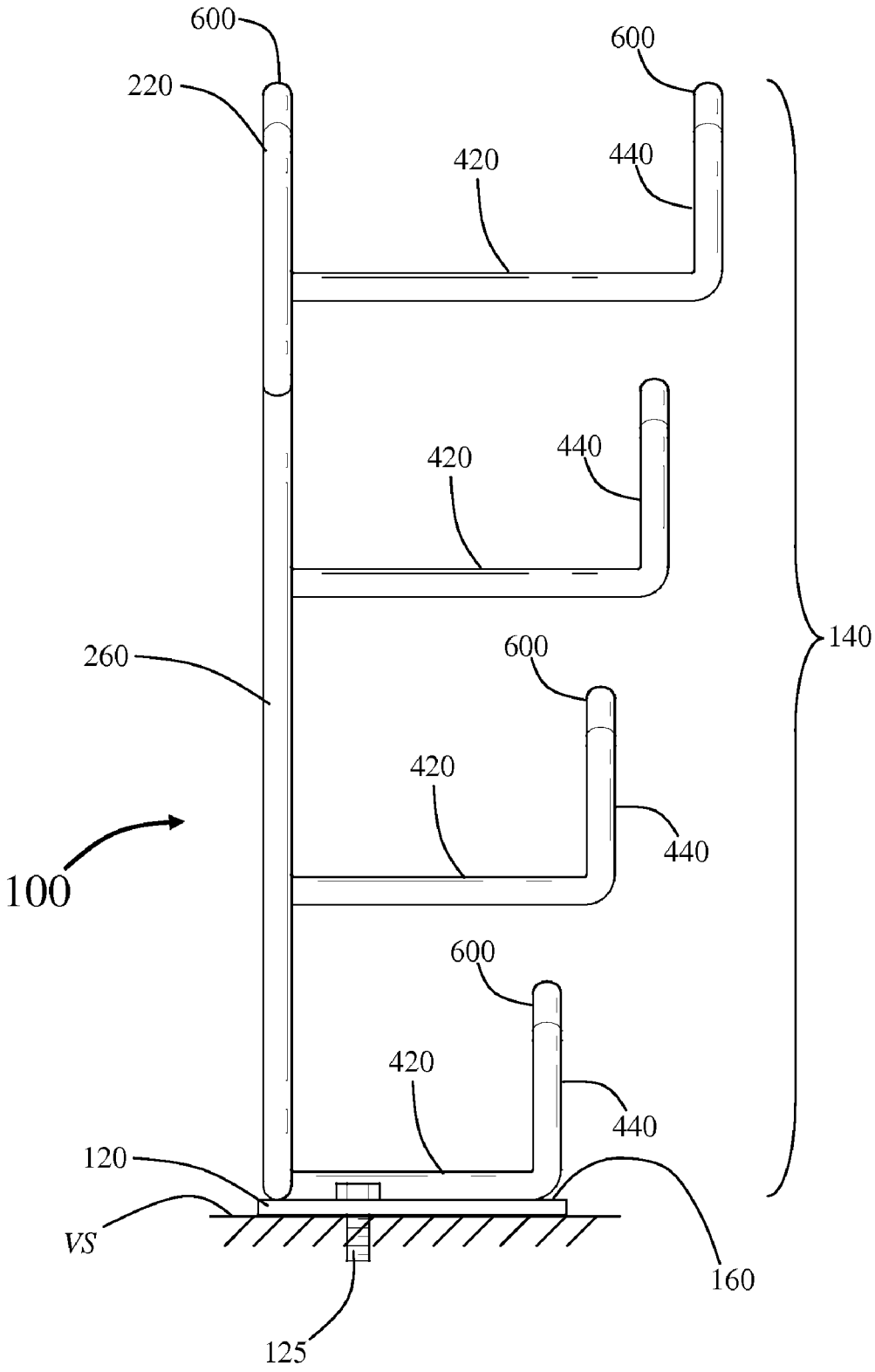
FIG. 9 shows a bottom view of the tool holder shown in FIG. 1.
Figure 10:
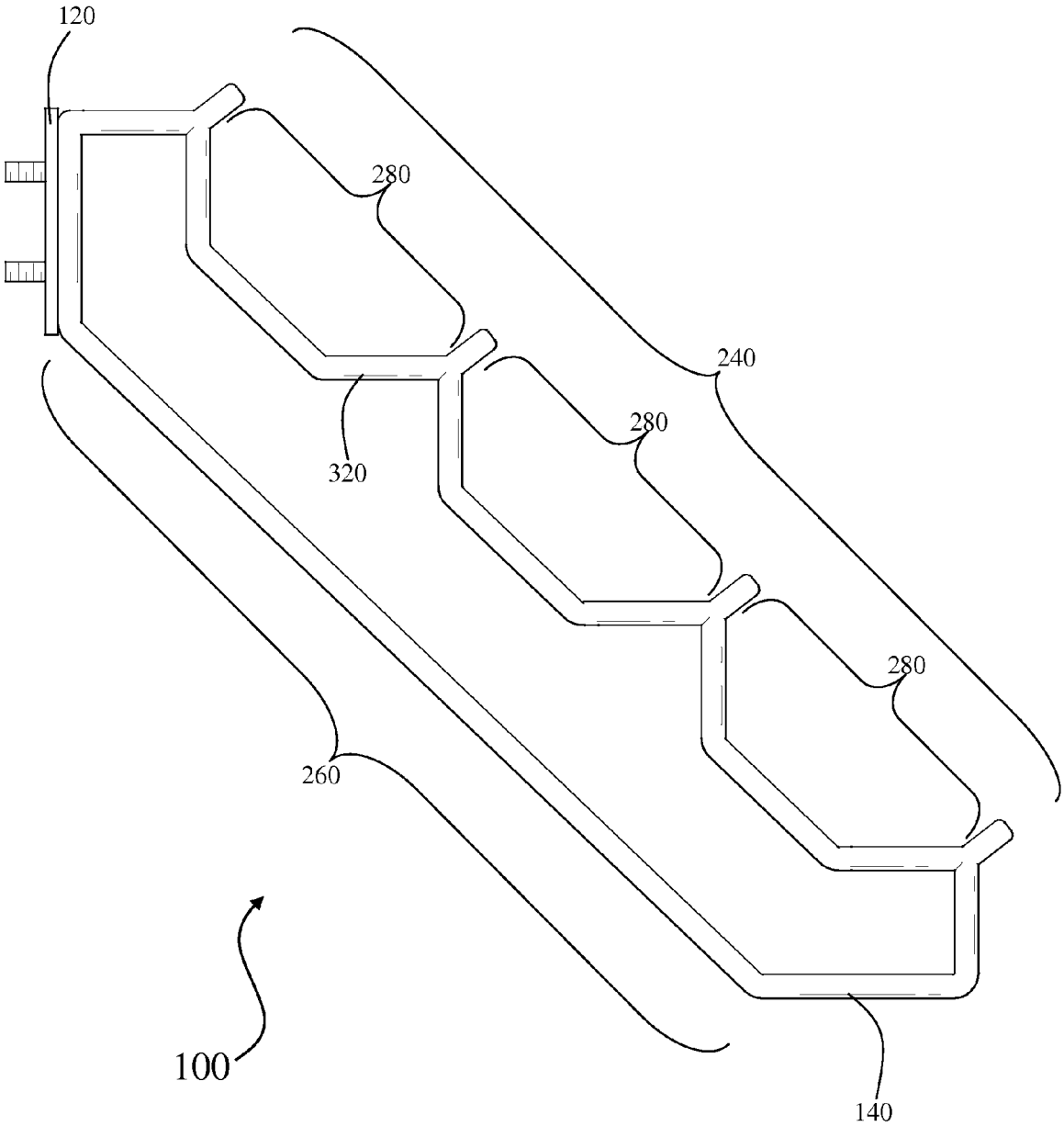
FIG. 10 shows a left-side view of the tool holder shown in FIG. 1.

In another embodiment the tool support hooks 360 extend outwards alternatively from each side of the tool support assembly 140 as shown in FIG. 5. More specifically, the tool support hooks 360 alternatively straddle the left and right sides 700 and 800 of the tubular tool support assembly 140 as shown in FIG. 5.

It is to be understood that the present invention is not limited to the embodiments described above, but encompasses any and all embodiments within the scope of the following claims.

I claim:

1. A tool holder 100, comprising:

a back plate 120, said back plate 120 defines a front face surface 160 and a rear side 180; and a tubular tool support assembly 140, said tubular tool support assembly 140 defines opposite first 200 and second 220 ends, wherein said first end 200 of said tubular tool support assembly 140 is attached to the front face surface 160 of said back plate 120 such that when said back plate 120 is held in a vertical plane then said tubular tool support assembly 140 extends at a downward angle from said front face surface 160 of said back plate 120,said tubular tool support assembly 140 defines upper 240 and lower 260 downward sloping sides, said upper side 240 of said tubular support assembly 140 comprises a plurality of handle bar sections 280, wherein each of said handle bar sections 280 define an upper tube section 300, a lower tube section 320 and a middle tube section 340 therebetween, wherein at least one lower tube section 320 is aligned in a horizontal plane when said back plate 120 is aligned in a vertical plane, wherein at least one of said lower tube sections 320 forms part of a tool support hook 360, wherein at least one tool support hook 360 is aligned in a horizontal plane when said back plate 120 is aligned in a vertical plane, and wherein said lower side 260 of said tubular tool support assembly 140 is substantially parallel to at least one middle tube section 340.

2. The tool holder 100 according to claim 1, wherein said tubular tool support assembly 140 further defines left 700 and right sides 800 thereof, and said tool support hooks 360 straddle the left side 700 of said tubular tool support assembly 140.

3. The tool holder 100 according to claim 1, wherein said tubular tool support assembly 140 further defines left 700 and right 800 sides thereof, and said tool support hooks 360 alternatively straddle the left 700 and right 800 sides of said tubular tool support assembly 140.

4. The tool holder 100 according to claim 1, wherein said tubular tool support assembly 140 further defines left 700 and right sides 800 thereof, and said tool support hooks 360 straddle the right side 800 of said tubular tool support assembly 140.

* * * * *